US005461553A

United States Patent [19]

Neumann et al.

[11] Patent Number: 5,461,553

[45] Date of Patent: Oct. 24, 1995

[54] HEADLIGHT FOR VEHICLE

[75] Inventors: Rainer Neumann, Stuttgart; Heike Eichler, Reutlingen, both of Germany

[73] Assignee: Robert Bosch GmbH, Stuttgart, Germany

[21] Appl. No.: 314,241

[22] Filed: Sep. 28, 1994

[51] Int. Cl.[6] ..... F21V 7/00

[52] U.S. Cl. ..... 362/305; 362/61; 362/343

[58] Field of Search ..... 362/61, 305, 343

[56] References Cited

U.S. PATENT DOCUMENTS

| | | | |
|---|---|---|---|
| 4,669,032 | 5/1987 | Lietar et al. | 362/61 |
| 4,922,389 | 5/1990 | Nino | 362/305 |
| 4,953,063 | 8/1990 | Nino | 362/305 |
| 5,307,247 | 4/1992 | Cejnek | 362/61 |

FOREIGN PATENT DOCUMENTS

| | | | |
|---|---|---|---|
| 3339879 | 5/1985 | Germany . | |
| 2255625 | 11/1992 | United Kingdom | 362/305 |

*Primary Examiner*—Carroll B. Dority
*Attorney, Agent, or Firm*—Michael J. Striker

[57] ABSTRACT

A headlight for a vehicle comprises a reflector. A light source having a light body. A shutter forming an upper bright-dark limit of a light bundle exiting the headlight. A lens arranged after the shutter is considered in a light outlet direction so that light reflected by the reflector passes through the lens. The reflector being formed so that light produced by the light body is reflected by the reflector so that it intersects an optical axis of the reflector and from the apex region of the reflector great images of the light body are reflected so that after passing through the lens they are arranged substantially close to the bright-dark limit. The reflector having a shape which is determined so that a distance along the optical axis between an apex point of the reflector on the optical axis and intersecting points of light rays reflected by the reflector with the optical axis starting from the apex region of the reflector to an edge region facing the apex region in the light outlet direction is changeable so that after passing through the lens at least approximately all images of the light body are arranged substantially close to the bright-dark limit.

12 Claims, 10 Drawing Sheets

10
12
F1
14
24
25
26
18
x
F2
16
22
20

HEADLIGHT FOR VEHICLE

BACKGROUND OF THE INVENTION

The present invention relates generally to a headlight for a vehicle.

More particularly, it relates to a headlight with a reflector, a light source having a light body, a shutter forming an upper bright-dark limit and a lens provided after the shutter in the light outlet direction for passing the light reflected by the reflector.

Headlights of the above mentioned general type are known in the art. One of such headlights is disclosed in the German document DE 33 39 879 A1. This headlight has also a reflector with a light source having a lightbody. The shutter is arranged in a beam path of the lightreflected by the reflector and forms an upper bright-dark limit of a light: bundle exiting the headlight. The lens arranged after the shutter in the light outlet direction allows the light reflected by the reflector pass through and deviate it for forming the light bundle exiting the headlight. The reflector has an ellipsoidal shape and reflects the light emitted by the light body so that it crosses the optical axis of the reflector. Great images of the lightbody are reflected from the apex region of the reflector and after passing through the lens are arranged on a measuring screen located before the distance from the apex region smaller images of the lightbody are reflected by the reflector and after passing through the lens are arranged on the measuring screen with increasing distance under the bright-dark limit to provide a stronger illumination in the lower region of the measuring screen which during use of the vehicle corresponds to the front field near the vehicle. This strong illumination of the front field is however not favorable for the visibility conditions of the vehicle driver. Therefore in known headlights an additional shutter is provided which screens the smaller images of the light body reflected from the reflector, so that they do not exit the headlight and can illuminate the lower region of the measuring screen or the front field in front of the vehicle. This additional shutter is connected however with a substantial light loss.

SUMMARY OF THE INVENTION

Accordingly, it is an object of the present invention to provide a headlight of the above mentioned general type, which avoids the disadvantages of the prior art.

In keeping with these objects and with others which will become apparent hereinafter, one feature of the present invention resides, briefly stated, in a headlight in which the shape of the reflector is determined so that the distance along the optical axis between the apex point of the reflector on the optical axis and the intersecting point of the light rays reflected by the reflector with the optical axis starting from the apex region of the reflector to the edge region provided in the light outlet direction is changeable so that after passing through the lens at least approximately all images of the light body are arranged substantially adjacent to the bright-dark limit.

When the reflector is designed in accordance with the present invention, the smaller images of the light body reflected by the reflector near the bright-dark limit ensure that an excessively strong illumination of the front field in front of the vehicle is avoided and simultaneously near the bright-dark limit high illumination intensity values are obtained.

In accordance with another feature of the present invention the images of the light body are arranged along the bright-dark limit with at least partial overlapping of one another.

The headlight can be formed so that the images of the light body on a measuring screen arranged in front of the headlight extend downwardly to the lowermost limit under an angle of maximum 4–10 degree, with its outermost limit up to an angle of maximum between 24 and 32 degree and this angle is formed between a connecting line extending from the reflector to the center point of the measuring screen and the connecting line extending from the reflector to the lowermost limit of the images or between the first mentioned connecting line and a connecting line extending from the reflector to the outermost limit of the images.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
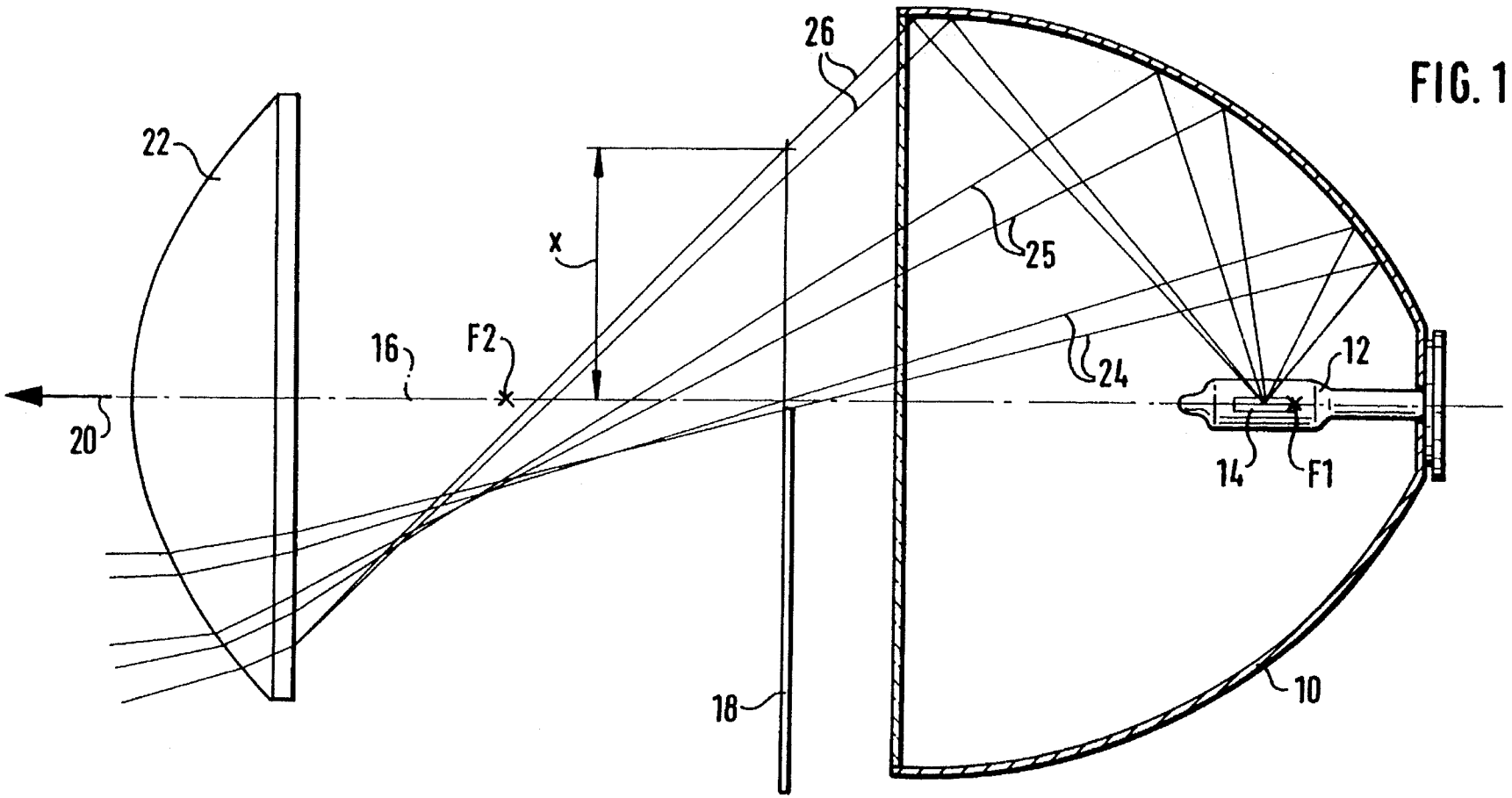
FIG. 1 is a view showing a headlight for a vehicle in a vertical longitudinal section with associated ray path.

FIG. 1 shows a known headlight for a vehicle, which has a reflector 10 and a light source 12 arranged in its apex region and provided with light body 14. The light body 14 is arranged on the optical axis 16 of the reflector 10 and extends parallel to it. The reflector 10 has an ellipsoidal shape. In other words in the axial longitudinal sections through the reflector 10 which contain the optical axis 16 ellipses are formed as section lines. The vertical axial longitudinal section through the reflector 10 shown in FIG. 1 has an ellipse provided with an inner focal point F1 and an outer focal point F2. The light body 14 is spaced further from the apex of the reflector 10 on the optical axis 16 than the inner focal point F1. The ray path of the light reflected by the reflector 10 is arranged on a shutter 18 which extends under the optical axis 16 and located on the optical axis 16 with offset relative to the outer focal point F2 toward the apex of the reflector 10. With the shutter 18, an upper bright-dark limit of the light bundle exiting the headlight is formed.

A lens 22 is arranged after the shutter 18 as seen in the light outlet direction 20. The light reflected by the reflector 10 and extending along the shutter 18 passes through the lens and is thereby deviated so that it extends at least in vertical planes substantially parallel to the optical axis 16. The light emitted by the light body 14 is reflected by the reflector 10 so that it intersects the optical axis 16. Since the light body 14 is not arranged in the inner focal point F1 of the reflector 10, the light rays reflected by the reflector 10 intersect the optical axis 16 not in the outer focal point F2 but instead are more or less offset relative to the latter. Light rays reflected from the apex region of the reflector 10 are identified in FIG. 1 with reference numeral 24. Light rays reflected by the front edge region of the reflector 10 as considered in the light outlet direction 20 are identified with 26, while light rays reflected by an intermediate region of the reflector arranged between the apex region and the edge region are identified with reference numeral 25. The light rays 24 reflected by the apex region of the reflector 10 intersect the optical axis 16 substantially in the plane in which the shutter 18 is arranged. The light rays reflected by the intermediate region intersect the optical axis 16 after the shutter 18 in the light outlet direction 20 and extend in a plane in which the shutter 18 is arranged, substantially above the optical axis 16. The light rays 26 reflected by the edge region of the reflector 10 intersect the optical axis 16 further after the shutter 18 than the light rays 25 as considered in the light outlet direction 20 and extend in a plane in which the shutter 18 is arranged, farther from the optical axis 16 than the light rays 25. The maximum distance of the light rays 26 in the plane in which the shutter 18 is arranged, is identified in FIG. 1 with x. By the apex region of the reflector 10 the great images of the light body 14 are reflected. The further reflector region is spaced from the apex region, the smaller are the images of the light body 14 reflected by this reflector region. The light rays 24 represent therefore great images of the light body and the light rays 25 and 26 represent increasingly smaller images of the light body 14.

Figure 2:
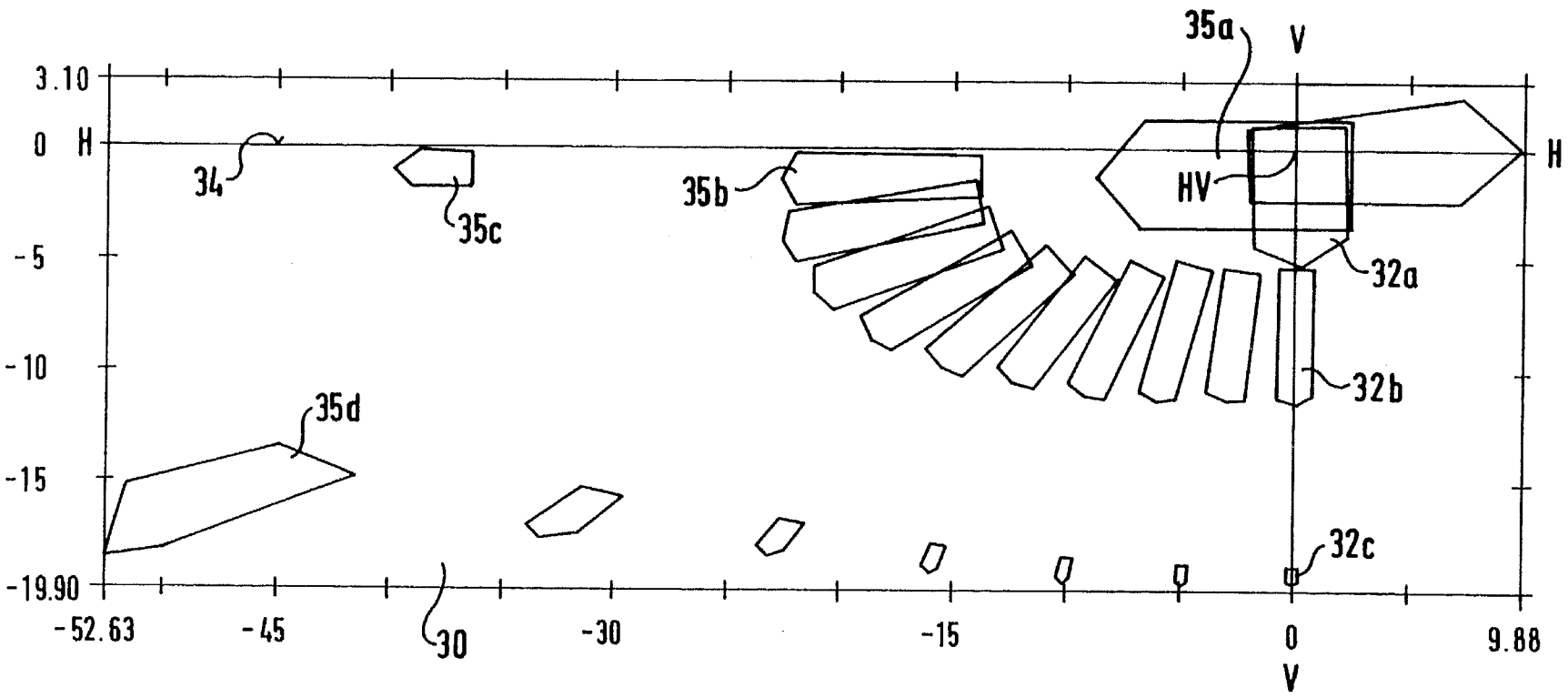
FIGS. 2 and 3 are views showing correspondingly a measuring screen with images of the light body produced by a known headlight.
Figure 3:
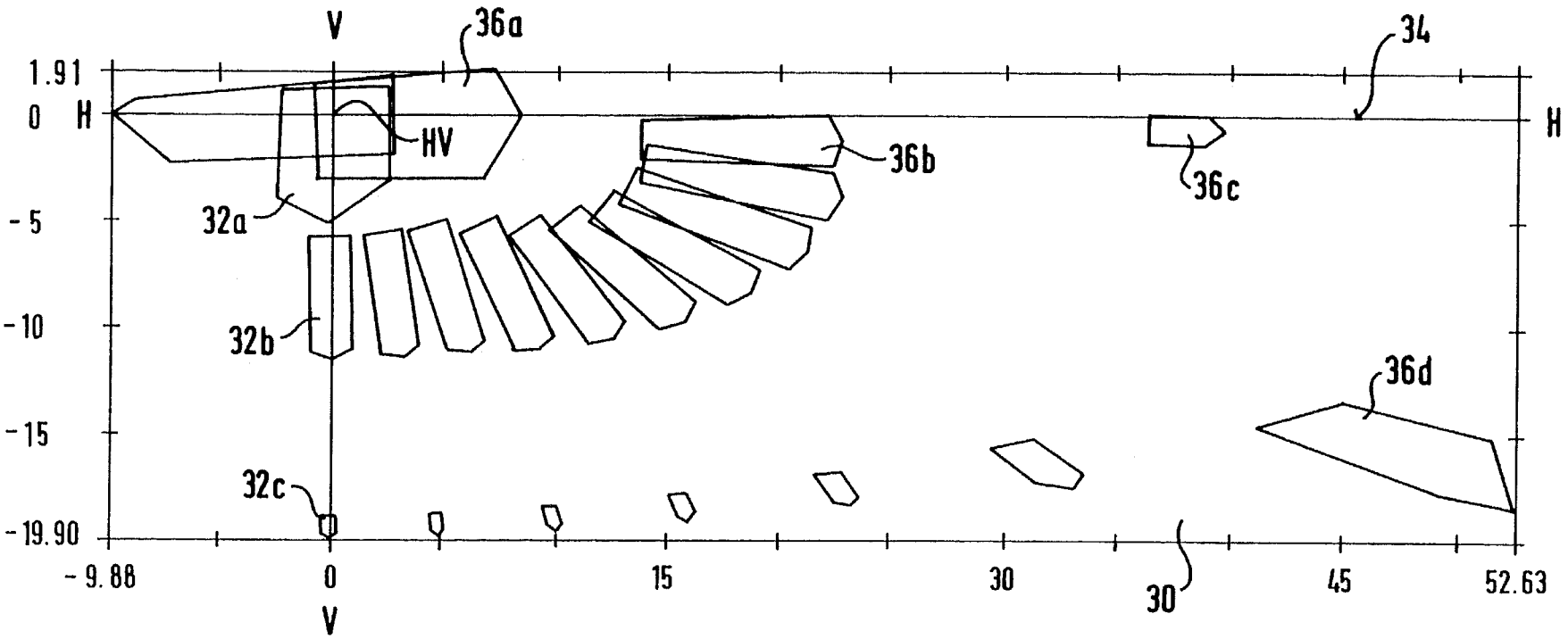

FIGS. 2 and 3 show a part of a measuring screen 30 which is arranged at a predetermined distance, for example 25 meter between front of the headlight and illuminated by the light beam exiting the headlight. The measuring screen 30 has a horizontal central plane HH and a vertical central plane VV. Selected images of the light body 14 are shown on the measuring screen 30, which in the illustration of FIG. 2 are reflected from the right upper quadrants of the reflector 10 as considered ill the light outlet direction 20 and in the illustration of FIG. 3 are reflected from the left upper quadrants of the reflector 10 as considered in the light outlet direction 20. The images of the light body 14 identified in FIGS. 2 and 3 with 32*a, b, c* are reflected by the reflector 10 in the region of its vertical section and are arranged with their longitudinal extension vertically. The great images 32*a* of the light body 40 are represented by the light rays 24 in FIG. 1 and are arranged on the measuring screen 30 near the bright-dark limit 34. The images 32*b* of the light body 14 represented by the light rays 25 are somewhat smaller than the image 32*a* and are arranged downwardly substantially spaced from the bright-dark limit 34. The images 32*c* represented by the light rays 24 are smaller than the images 32*b* and are spaced downwardly from the bright-dark limit 32 farther than the images 32*b*. The smaller images 32*c* of the light body 14 extend up to an angle of substantially 20 degree underneath the horizontal central plane HH of the measuring screen 30. The angle of 20 degree is formed as the angle between a connecting line extending from the headlight to the intersection point HV of the horizontal central plane HH with the vertical central plane VV of the measuring screen 30 and the image 32*c* of the light body 14 which are spaced the farthest downwardly from the bright-dark limit 34 starting from the headlight to the lowest limit. The images of the light body 14 identified in FIG. 2 with 35*a, b, c* are reflected from the right half of the reflector 10 in the region of its horizontal axial longitudinal section and are arranged with their longitudinal extension horizontally. Here also the great images 35*a* are reflected from the apex region of the reflector 10 and arranged adjacent to the vertical central plane VV of the measuring screen 30. The smaller the images 35*b, c* are, the farther the reflector region from which these images are reflected is spaced from the apex region and the farther are they arranged in horizontal direction from the vertical central plane VV on the measuring screen 30. The same is true for the images of the light body 14 identified with 36*a, b, c* which are reflected from the left part of the reflector 10. The remaining images of the light body 14 shown in FIGS. 2 and 3 are reflected from the regions of the reflector 10 between the vertical and horizontal axial longitudinal sections and are arranged inclined more or less between the vertical orientation of the images 32*a, b, c* and the horizontal orientation of the image 35*a, b, c* or 36*a, b, c*. The images 35*d* or 36*d* of the light body 14 which are spaced in the horizontal direction the farthest from the vertical central plane VV of the measuring screen 30 extend with their outermost limits to both sides of the vertical central plane VV to an angle of substantially 53 degree. The angle of 53 degree is provided between a connecting line starting from the headlight to the point HV of the measuring screen 30 and a connecting line extending from the headlight to the outermost limits of the farthest spaced images 35*d* or 36*d* of the light body 14.

Figure 4:
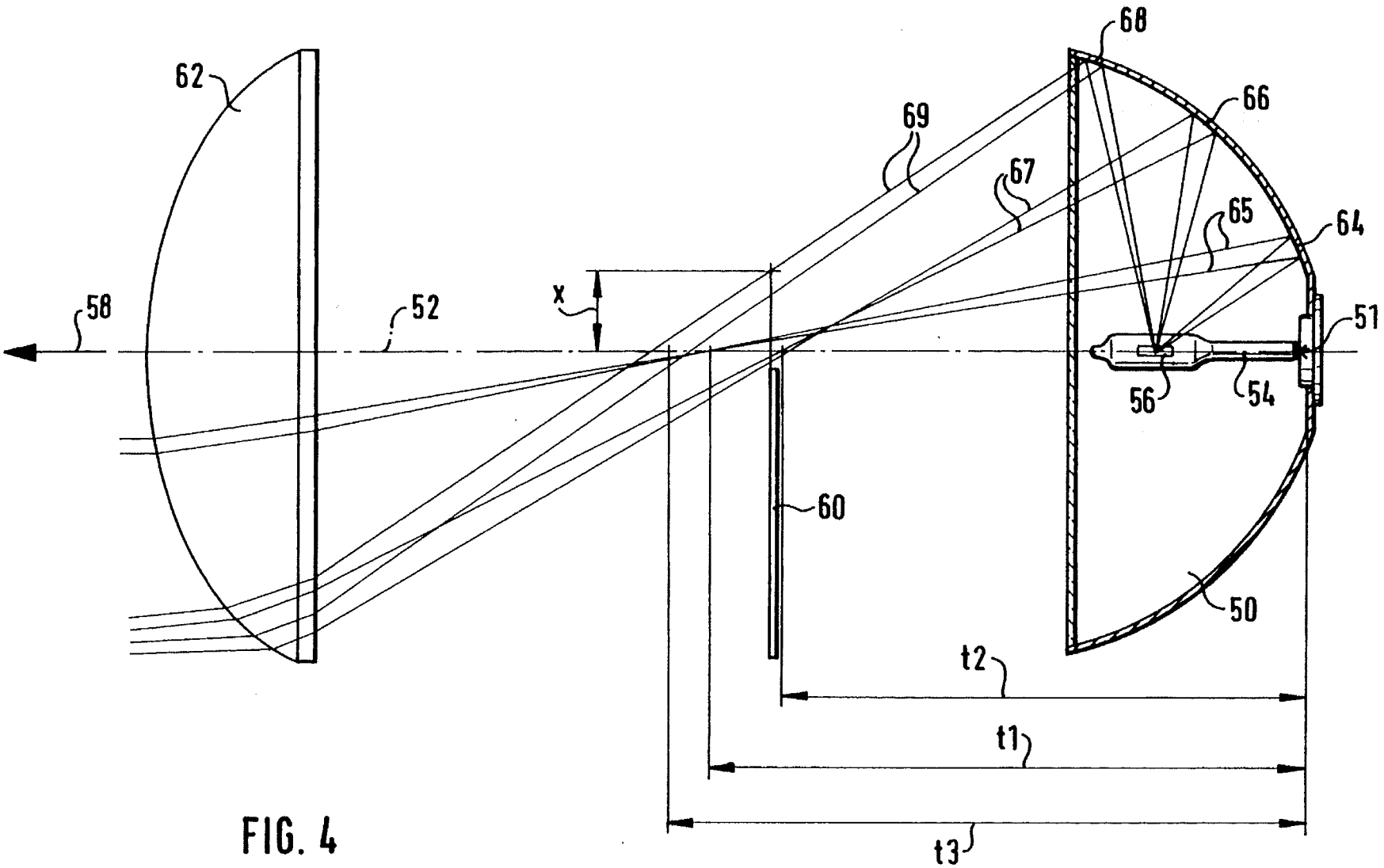
FIG. 4 is a view showing a headlight in accordance with the present invention in a vertical longitudinal section with associated ray path.

FIG. 4 shows a headlight in accordance with the present invention. It has a reflector 50 with an optical axis 52 and a light source 54 arranged in its apex region and having a light body 56. The light source 54 can be an incandescent lamp or as discharge lamp and its light body 56 can be arranged transversely to the optical axis 52 or in the shown embodiment along the optical axis 52. As seen in the light outlet direction 58, a shutter 60 is arranged after the reflector 50. It extends under the optical axis 52 and forms an upper bright-dark limit of the light bundle exiting the headlight. A lens 62 is arranged after the shutter 60 as considered in the light outlet direction 58. Light reflected by the reflector 50 and extending along the shutter 60 passes through the lens and is deviated so that at least in vertical planes it extends substantially parallel to the optical axis 52. The lens 62 corresponds in its action to a collecting lens and in the shown embodiment is formed as a plan-convex lens. It has a plan surface facing the reflector apex and an opposite convex aspherical surface.

The light from the light body 56 is reflected by the reflector 50 so that it intersects the optical axis 52 in the region of the shutter 60 or as seen in the light outlet direction after the shutter 60. In the vertical axial longitudinal section of FIG. 4 the light rays 65 reflected by the apex region 64 of the reflector 50 intersect the optical axis 52 at a distance t1 as considered in the light outlet direction 58 after the apex point 51 of the reflector 50 on the optical axis 52 substantially in a plane in which the shutter 18 is arranged. The light rays 67 reflected from an intermediate region 66 of the reflector 50 which follows the apex region 64 intersect the optical axis 52 at a distance t2 after the apex point 51 and after the shutter 60 and extend in a plane in which the shutter 60 is arranged, substantially above the optical axis 52. Light rays 69 reflected from an edge region 68 of the reflector 30 which follows the intermediate region 66 intersects the optical axis 52 at a distance t3 after the apex point 51 and after the shutter 60. This distance is greater than the distance t2 and greater than the distance t1. The light rays 69 extend in a plane in which the shutter 60 is arranged, farther above the optical axis 52 than the light rays 67. Starting from the apex region 64 to the central region 66 of the reflector 50, the distance between the apex point 51 or the shutter 60 and the intersecting points of the light rays with the optical axis 52 is first smaller and subsequently increases to the edge region 68. In FIG. 4 the maximal distance under which the light rays 69 in the plane in which the shutter 60 is arranged are spaced from the optical axis 52 is identified as x. The distance x in the inventive headlight shown in FIG. 4 is substantially smaller than in the known headlight of FIG. 1.

Figure 5:
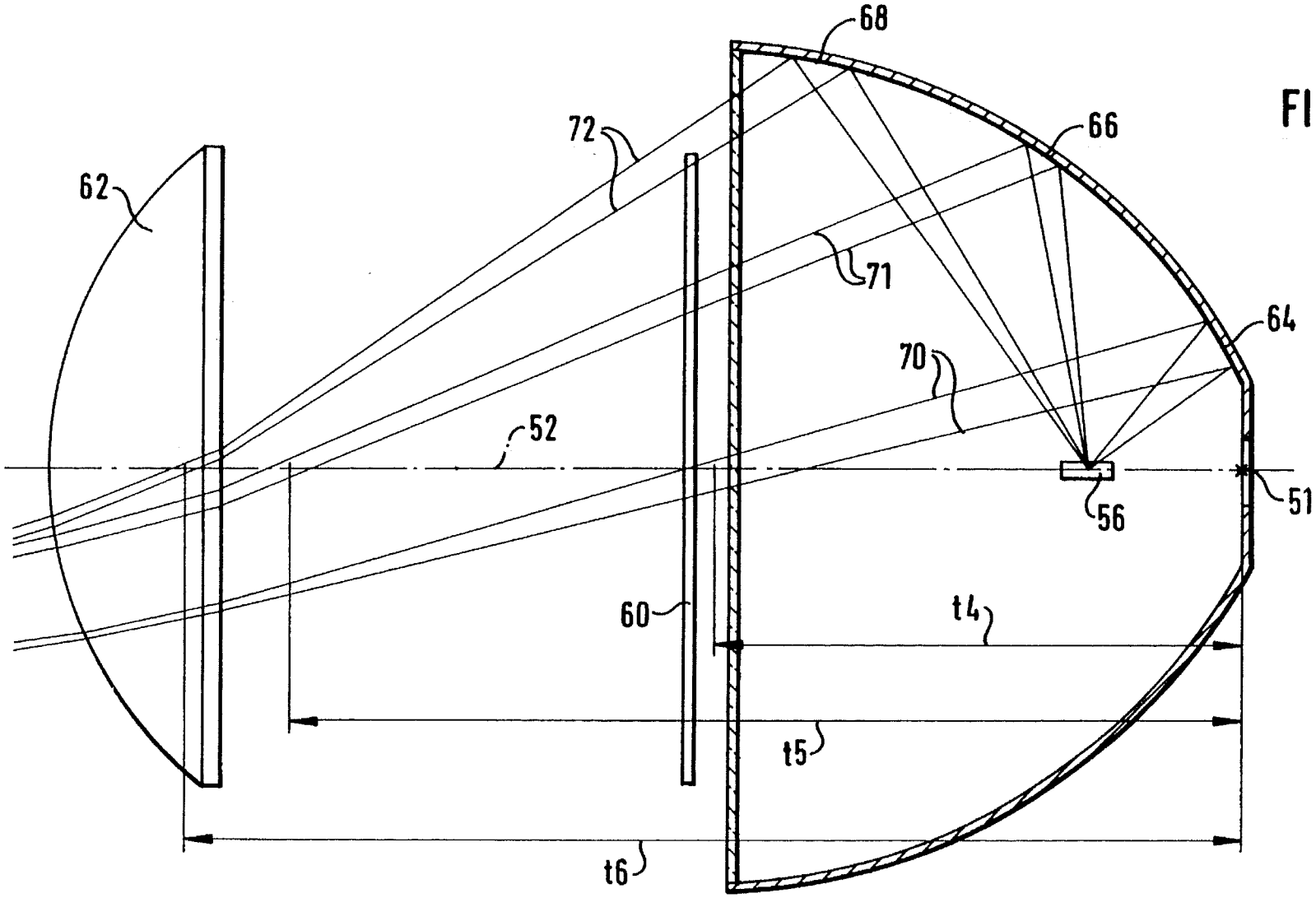
FIG. 5 is a view showing the reflector of FIG. 4 in a horizontal longitudinal section with associated ray path.

As can be seen from FIG. 5 which shows horizontal axial longitudinal section the light rays 70 reflected from the apex region 64 of the reflector intersect the optical axis 52 at a distance t4 in the light outlet direction 58 after the apex point 51 and substantially in front of the shutter 60. The light rays 71 reflected from the intermediate region 66 of the reflector 50 which follows the apex region 64 intersect the optical axis 52 at a distance t5 in the light outlet direction after the apex point 51 and after the shutter 60. The light rays 72 reflected from the edge region 68 of the reflector 50 which follows the intermediate region 66 intersect the optical axis 52 at a distance t6 after the apex point 51 and after the shutter 60 wherein the distance t6 is greater than the distance t5. Starting from the apex region 64 to the edge region 68, the light rays reflected by the reflector 50 intersect the optical axis 52 at an always increasing distance from the apex point 51, whereas in the edge region 68 the distance t6 at which the light rays intersect the optical axis 52 remains substantially constant and no longer increases further.

Figure 6:
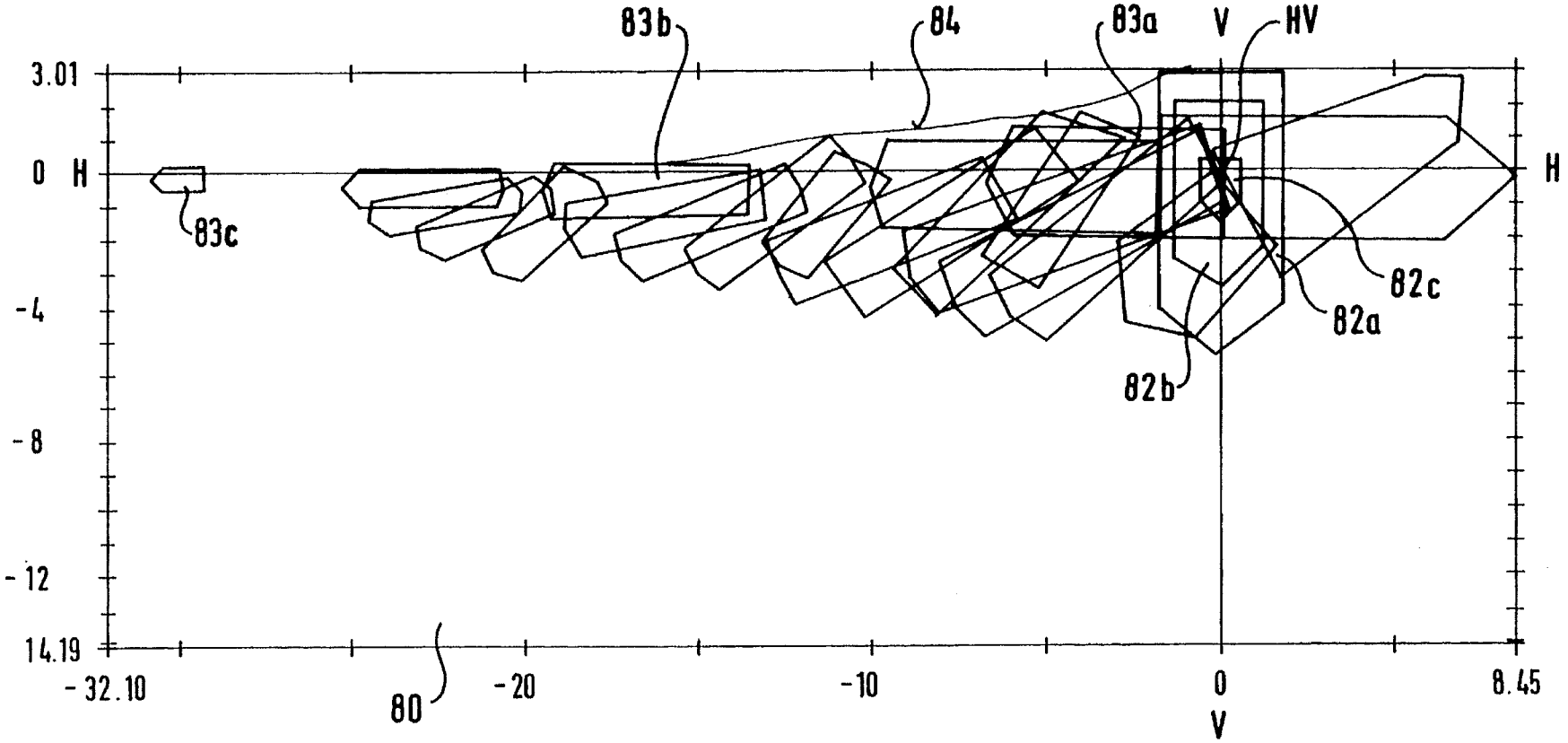
FIGS. 6–9 are views showing a measuring screen with images of the light body provided by the reflector in accordance with the present invention.
Figure 7:
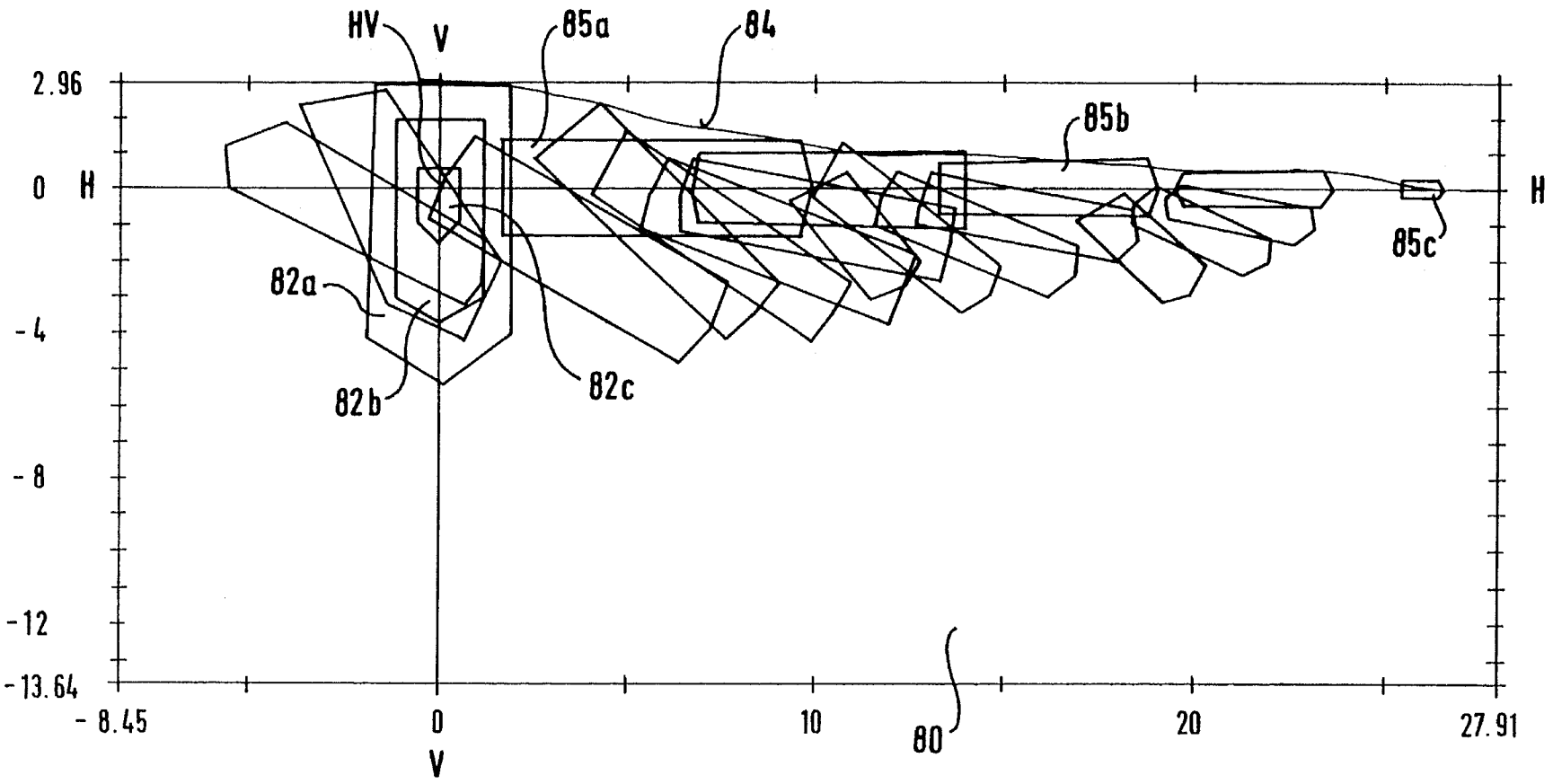

FIG. 6 shows a part of a measuring screen 80 arranged in front of the headlight for example at 25 meter from it on which the images of the light body 56 are shown. They are reflected from the right upper quadrants of the reflector 50 as considered in the light outlet direction 58. The horizontal central plane of the measuring screen 80 is identified again with HH and the vertical central plane with VV. The images of the light body 56 reflected by the reflector 50 in the region of the vertical axial longitudinal section are arranged with their longitudinal extension vertically, and selectively some of them are identified with reference numerals 82*a, b, c*. In FIG. 6 the images of the light body 56 reflected by the reflector 50 in the region of the horizontal axial longitudinal section are arranged with their longitudinal extension horizontally and selectively some of them also are identified with reference numerals 83*a, b, c*. In FIG. 7 the images of the light body 56 reflected from the left upper quadrants of the reflector 50 in the light outlet direction 58 are shown on the measuring screen 80. In FIG. 7 the selected images of the light body 56 reflected by the reflector 50 in the region of its vertical axial longitudinal section are identified as in FIG. 6 with reference numerals 82*a, b, c*. The selected images of the light body 56 reflected by the reflector 50 in the region of its horizontal axial longitudinal section are identified in FIG. 7 with the reference numerals 85*a, b, c*.

The size of the images 82*a, b, c* or 83*a, b, c* or 85*a, b, c* increases starting from the apex region 64 of the reflector 50 to its edge region 68. In other words the great images 82*a*, 83*a* or 85*a* are reflected by the apex region 64, the medium size images 82*b* or 83*b* or 85*b* are reflected by the intermediate region 66 of the reflector 50, and the smaller images 82*c*, 83*c* or 85*c* are reflected by the apex region 68. The images of the light body 56 reflected by the regions of the reflector 50 between its vertical and its horizontal axial longitudinal section are more or less inclined between the vertical extreme position of the images 82*a, b, c* and the horizontal extreme position of the images 83*a, b, c* or 85*a, b, c*. The great images 82*a* or 83*a* or 85*a* are located closely under the bright-dark limit 84 or adjoin with their upper edges the bright-dark limit 84. The medium size images 82*b*, or 83*b*, or 85*b* as well as small images 82*c* or 83*c* or 85*c* of the light body 56 are also arranged substantially close to the right-dark limit 84 or adjoin with their upper edges the bright-dark limit 84. The medium size images 82*b* as well as the small images 82*c* are arranged completely inside the great images 82*a*. The image 82*a, b, c* or 83*a, b, c* or 85*a, b, c* are superposed over one another at least partially along the bright-dark limit 84, so that their high illumination intensity values are obtained. In a vertical direction with respect to the horizontal central plane HH, the images 82*a, b, c* or 83*a, b, c* or 85*a, b, c* extend with their lowermost limits substantially up to under an angle of 4–6 degree downwardly. In a horizontal direction with respect to the vertical central plane VV the small images 83*c* reflected by the right quadrants of the reflector 50 extend with their outermost limits substantially up to an angle of substantially 25 to 32 degree to the vertical central plane VV, and the small images 85*c* reflected by the left quadrants of the reflector 50 extend with their outermost limits to an angle of substantially 24 to 28 degree to the vertical central plane VV.

Figure 8:
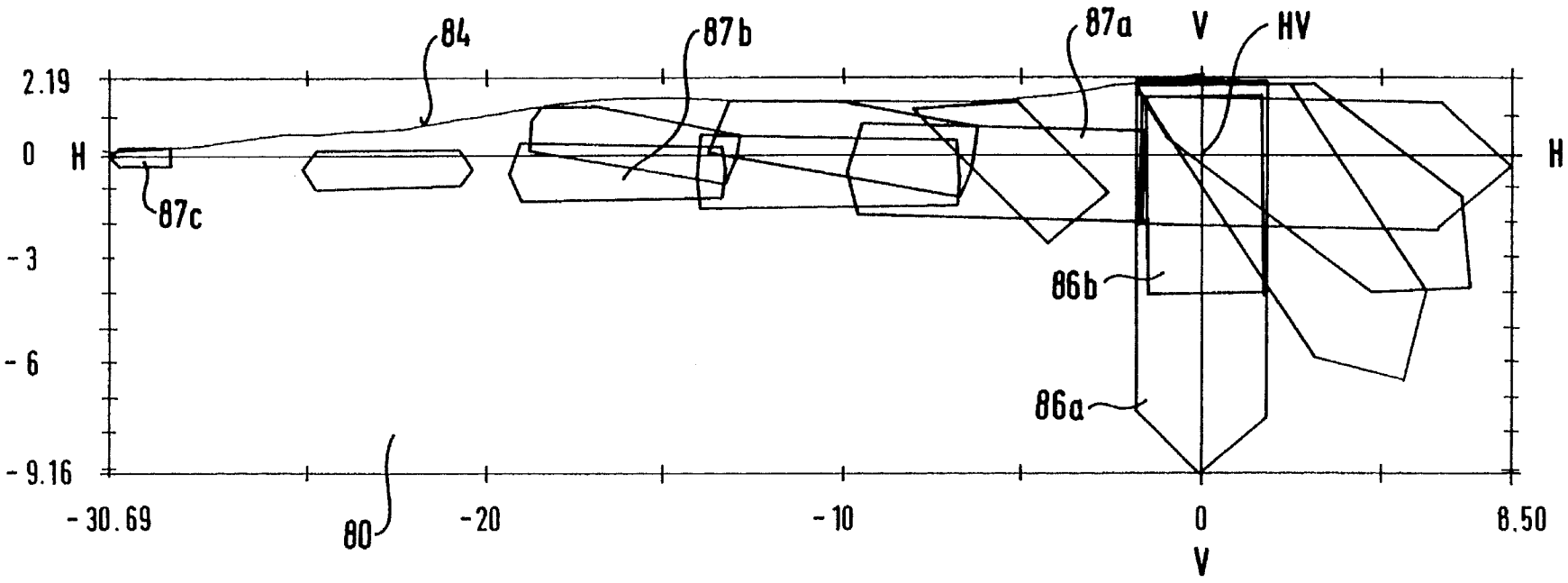
Figure 9:
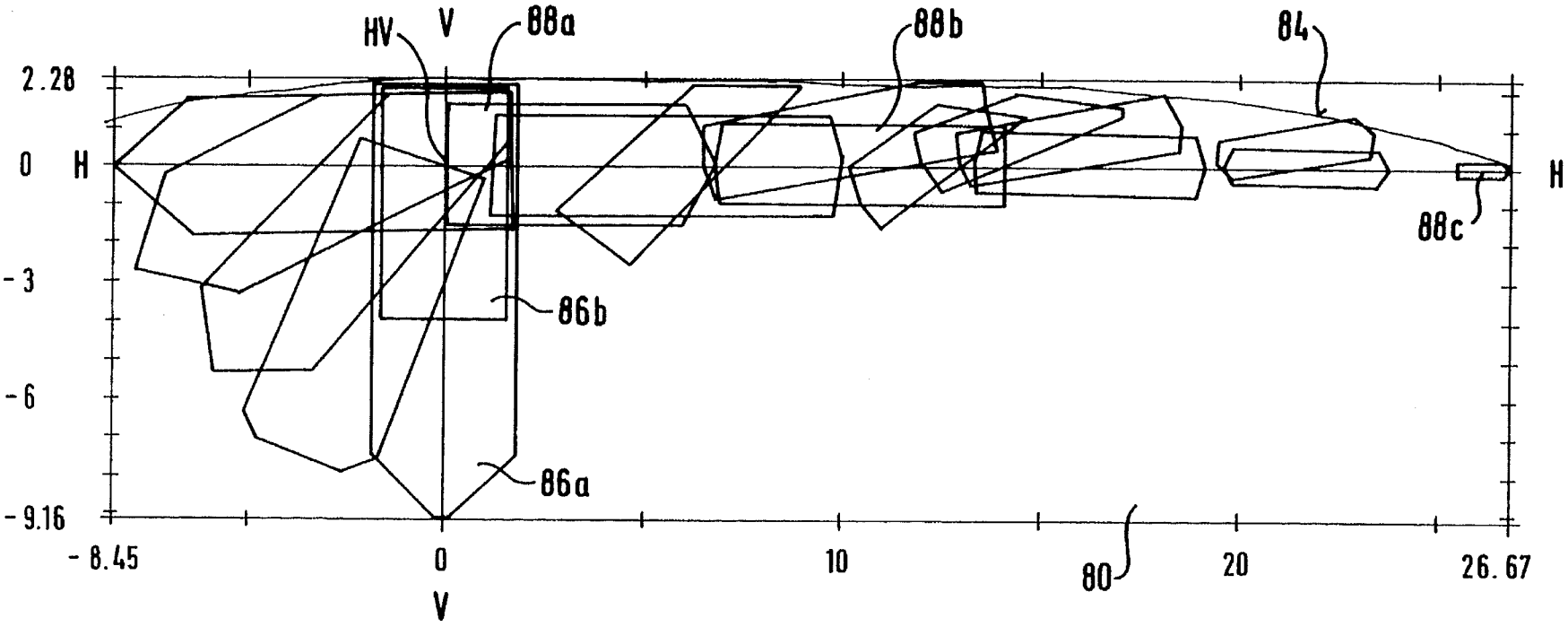

FIG. 8 shows images of the light body 56 on the measuring screen 80, which are reflected from the right lower quadrants of the reflector 50 as considered in the light outlet direction 58, and FIG. 9 shows images of the light body 56 on the measuring screen reflected by the left lower quadrants of the reflector 50. The images reflected by the reflector 50 in the region of its vertical axial longitudinal section are arranged with their longitudinal extension vertically and selected images are identified in FIGS. 8 and 9 with reference numerals 86*a, b*. The images of the light body 56 reflected from the right quadrants of the reflector 50 in the region of its horizontal axial longitudinal section are arranged with their longitudinal extensions horizontally, and selected images are identified in FIG. 8 with reference numerals 87*a, b, c*. The images reflected by the left quadrants of the reflector 50 in the region of its horizontal axial longitudinal section are arranged with their longitudinal extension also horizontally and selected images are identified in FIG. 9 with reference numerals 88*a, b, c*. The size of the images of the light body 56 increases starting from the apex region 54 to the intermediate region 66 of the reflector 50. The images of the light body 56 reflected by the lower edge region of the lower quadrants of the reflector 50 are screened by the shutter 60 so that they cannot exit the headlight. The images 86*a, b*, or 87*a, b, c* or 88*a, b, c* are arranged substantially close under the bright-dark limit 84 and they at least partially overlap. The images 86*a, b* or 87*a, b, c* or 88*a, b, c* extend in the vertical direction with respect to the horizontal plane HH with their lowermost limits substantially up to an angle of substantially 8 to 10 degree downwardly. In the horizontal direction with respect to the vertical central plane VV the small images 87*c* reflected by the right quadrant of the reflector 50 extend with their outermost limits substantially up to an angle of substantially 28 to 32 degree to the vertical central plane VV, and the small images 88*c* reflected by the left quadrants of the reflector 50 extend with their outermost limits up to an angle of substantially 24 to 28 degree relative to the vertical central plane VV.

The shape of the reflector 50 of the inventive headlight is determined from the consideration how the above described images of the light body 56 must be arranged on the measuring screen 80. Starting from the position of these images, with the use of reflection loss, the shape of the reflector 50 can be determined. The thusly produced shape of the reflector 50 is not represented by a single mathematical equation and does not constitute accurate ellipsoidal shape as in the previously known headlights.

When one compares FIGS. 2 and 3 in which the images of the light body extend in the vertical direction up to and under an angle of substantially 20 degree downwardly, it can be seen that the images of the light body 56 in the headlight in accordance with the present invention extend only up to an angle of substantially 4 to 10 degree downwardly. This is provided by the fact that the distance x under which the light rays 67 or 69 reflected by the intermediate region 66 and the edge region 68 of the reflector 50 in the plane in which the shutter 60 is arranged extends at a distance from the optical axis 52 which is substantially smaller than the distance in the known headlights. During the real use of the headlight in the vehicle, this arrangement of the image of the light body 56 provided a reduction of the illumination of the front field directly in front of the vehicle. From further comparison of FIGS. 2 and 3 in which the images of the light body in the horizontal direction extend up to an angle of substantially 53 degree to both sides of the vertical central plane VV, it can be seen that the images of the lightbody 56 in the headlight in accordance with the present invention extend up to an angle of substantially 24 to 32 degree to both sides of the vertical central plane VV. This means a reduction of the size dissipation. Since in the inventive headlight the small images of the light body are not screened by an additional shutter but instead are displaced in direction toward the bright-dark limit 84 vertically upwardly and additionally in the horizontal direction to the vertical central plane HV-point of the measuring screen 80 and overlap with the great images of the light body, a high illumination intensity is provided in the region of the HV-point and along the bright-dark limit 84.

Figure 10:
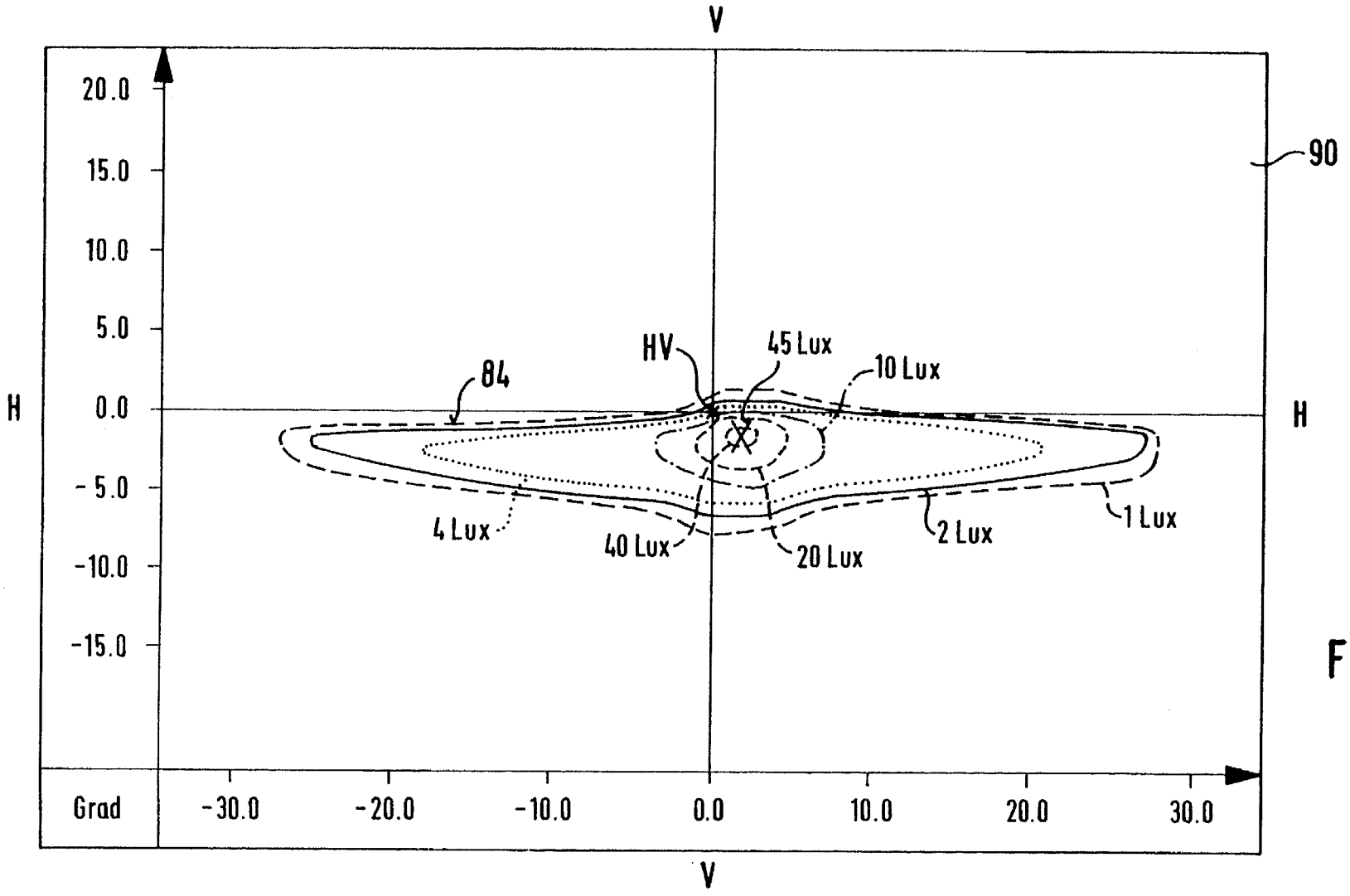
FIG. 10 is a view showing a measuring screen with an illumination intensity distribution provided by the headlight in accordance with the present invention.

A measuring screen 90 arranged in front of the headlight in FIG. 10 shows the lines with the same illumination intensity or so-called Isolux or Isocandela-lines. In the region of HV-point, or substantially to the right and down of it the greatest illumination intensity is offset and amounts to substantially 45 Lux or 28,000 Candela. Moreover, FIG. 10 shows several further lines corresponding to 45 Lux or 2,500 Candela, 20 Lux or 12,500 Candela, 10 Lux or 6,250 Candela, 4 Lux or 2,500 Candela, 2 Lux or 1,1250 Candela as well as 1 Lux or 625 Candela.

It will be understood that each of the elements described above, or two or more together, may also find a useful application in other types of constructions differing from the types described above.

While the invention has been illustrated and described as embodied in a headlight for vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A headlight for a vehicle, comprising a reflector; a light source having a light body; a shutter forming an upper bright-dark limit of a light bundle exiting the headlight; a lens arranged after said shutter as considered in a light outlet direction so that light reflected by said reflector passes through said lens, said reflector being formed so that light produced by said light body is reflected by said reflector so that it intersects an optical axis of said reflector and from an apex region of said reflector great images of said light body are reflected so that after passing through said lens they are arranged substantially close to said bright-dark limit, said reflector having a shape which is determined so that a distance along said optical axis between an apex point of said reflector on said optical axis and intersecting points of light rays reflected by said reflector with said optical axis starting from said apex region of said reflector to an edge region facing said apex region in the light outlet direction is changeable so that after passing through said lens at least approximately all images of said light body are arranged substantially close to said bright-dark limit.

2. A headlight as defined in claim 1, wherein said reflector is formed so that said images of said light body are arranged along said bright-dark limit with at least partially overlapping one another.

3. A headlight as defined in claim 1, wherein said reflector is formed so that said images of said light body extend on a measuring screen arranged in front of the headlight with their lowermost limit up to an angle of maximum substantially 4 to 10 degree downwardly, and said angle is formed between a connecting line extending from the headlight to a center point of said measuring screen and a connecting line extending from the headlight to a lowermost limit of said images.

4. A headlight as defined in claim 1, wherein said reflector is formed so that said images of said light body on a measuring screen arranged in front of the headlight extend with their outermost limit up to an angle of maximum substantially 24 to 32 degree outwardly, and said angle being formed between a connecting line extending from the headlight to a center point of said measuring screen and a connecting line extending from the headlight to an outermost limit of said images.

5. A headlight as defined in claim 1, wherein said shape of said reflector is determined so that in a vertical axial longitudinal section through said reflector as considered starting from said apex region of said reflector to an intermediate region which follows said apex region in the light outlet direction, light rays reflected by said reflector intersect said optical axis with a reducing distance from said apex point of the reflector, and further to an edge region which follows said intermediate region in said light outlet direction the reflected light rays intersect said optical axis in an increasing distance from said apex point of said reflector.

6. A headlight as defined in claim 1, wherein said said shape of said reflector is determined so that in a horizontal axial longitudinal section of said reflector starting from said apex region of said reflector to an intermediate region which follows said apex region in said light outlet direction, the light rays reflected by said reflector intersects said optical axis with an increasing distance from said apex point of said reflector and further to an edge region which follows said intermediate region in light outlet direction the reflected light rays intersect said optical axis with a substantially identically remaining distance from said apex point.

7. A method of producing a headlight for a vehicle, comprising the steps of providing a reflector; arranging a light source with a light body, a shutter which forms an upper bright-dark limit of a light bundle exiting the headlight, and a lens after said shutter in a light outlet direction so that light reflected by said reflector passes through said lens; forming said reflector so that light produced by said light body is reflected by said reflector so that it intersects an optical axis of the reflector and great images of said light body reflected from an apex region of said reflector are reflected so that after passing through said lens they are arranged substantially close to said bright-dark limit; and selecting a shape of said reflector so that a distance along said optical axis between an apex point of-said reflector on said optical axis and intersecting points of light rays reflected by said reflector with said optical axis starting from said apex region of said reflector to an edge region facing said apex region in the light outlet direction is changeable so that after passing through said lens at least approximately all images of said light body are arranged substantially close to said bright-dark limit.

8. A method as defined in claim 7, wherein said selecting of the shape of said reflector includes selecting the shape so that said images of said light body are arranged along said bright-dark limit with at least partially overlapping one another.

9. A method as defined in claim 7, wherein said selecting of the shape of said reflecting includes selecting the shape so that said images of said light body extend on a measuring screen arranged in front of the headlight with their lowermost limit up to an angle of maximum substantially 4 to 10 degree downwardly, and said angle is formed between a connecting line extending from the headlight to a center point of said measuring screen and a connecting line extending from the headlight to a lowermost limit of said images.

10. A method as defined in claim 7, wherein said selecting of the shape of said reflecting includes selecting the shape so that said images of said light body on a measuring screen arranged in front of the headlight extend with their outermost limit up to an angle of maximum substantially 24 to 32 degree outwardly, and said angle being formed between a connecting line extending from the headlight to a center point of said measuring screen and a connecting line extending from the headlight to an outermost limit of said images.

11. A method as defined in claim 7, wherein said selecting the shape of said reflector includes selecting the shape so that in a vertical axial longitudinal section through said reflector as considered starting from said apex region of said reflector to an intermediate region which follows said apex region in the light outlet direction, light rays reflected by said reflector intersect said optical axis with a reducing distance from said apex point of the reflector, and further to an edge region which follows said intermediate region in said light outlet direction the reflected light rays intersect said optical axis in an increasing distance from said apex point of said reflector.

12. A method as defined in claim 7, wherein said selecting the shape of said reflector includes selecting the shape so that in a horizontal axial longitudinal section of said reflector starting from said apex region of said reflector to an intermediate region which follows said apex region in said light outlet direction, the light rays reflected by said reflector intersects said optical axis with an increasing distance from said apex point of said reflector and further to an edge region which follows said intermediate region in light outlet direction the reflected light rays intersect said optical axis with a substantially identically remaining distance from said apex point.

* * * * *